US007198530B1

(12) United States Patent
Rothe et al.

(10) Patent No.: US 7,198,530 B1
(45) Date of Patent: Apr. 3, 2007

(54) RESILIENT MOUNT SYSTEM FOR AN OUTBOARD MOTOR

(75) Inventors: Neil A. Rothe, Campbellsport, WI (US); Daniel P. Klawitter, Beaver Dam, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/209,420

(22) Filed: Aug. 23, 2005

(51) Int. Cl.
*B63H 1/15* (2006.01)

(52) U.S. Cl. ..... 440/52

(58) Field of Classification Search ..... 440/52
See application file for complete search history.

(56) References Cited

U.S. PATENT DOCUMENTS

| | | | | |
|---|---|---|---|---|
| 3,514,089 | A * | 5/1970 | Harbers | 267/269 |
| 5,180,319 | A | 1/1993 | Shiomi et al. | 440/52 |
| 5,366,411 | A * | 11/1994 | Harpin | 464/17 |
| 6,341,991 | B1 * | 1/2002 | Ogino | 440/53 |
| 6,354,893 | B1 | 3/2002 | Sato | 440/52 |
| 6,390,863 | B1 | 5/2002 | Imanaga | 440/53 |
| 6,419,534 | B1 | 7/2002 | Helsel et al. | 440/52 |

* cited by examiner

*Primary Examiner*—Stephen Avila
(74) *Attorney, Agent, or Firm*—William D. Lanyi

(57) ABSTRACT

The support structure for an outboard motor provides a connection bar between an engine support structure and a steering structure. A tubular outer member is spaced apart from the attachment bar and connected to the attachment bar with an elastomeric member. Vibration isolation and consistency of deformation is achieved through the interaction of the individual elements of the structure.

19 Claims, 3 Drawing Sheets

RESILIENT MOUNT SYSTEM FOR AN OUTBOARD MOTOR

BACKGROUND OF THE INVENTION

1. Field of the Invention

The present invention is generally related to a mount system for an outboard motor and, more particularly, to a mount system that incorporates an elastomeric member disposed between an inner attachment bar and a tubular outer member.

2. Description of the Related Art

Those skilled in the art of marine propulsion systems and, more particularly, outboard motors are aware of many different types of mounting systems that use resilient members to absorb vibration and dampen shock loads to prevent the transfer of noise and vibration from the engine of the outboard motor to the marine vessel to which it is attached.

U.S. Pat. No. 5,180,319, which issued to Shiomi et al. on Jan. 19, 1993, describes a joint structure with an elastic mount. The joint structure joins an outboard motor assembly to a boat hull. The outboard engine assembly has an engine, a case, a propeller rotatably supported on the case and drivable by the engine. The joint structure includes an attachment adapted to be coupled to the boat hull, the case having an inner surface defining an inner housing region, and elastic mount mechanism accommodated in the inner housing region for elastically supporting the case to the attachment.

U.S. Pat. No. 6,354,893, which issued to Sato on Mar. 12, 2002, describes a mounting structure for an outboard motor. The axis of a driveshaft is disposed at a position offset away from the axis of a crankshaft of an engine by a small amount to the rear of the outboard motor. A pair of left and right mount holders are formed adjacent to the center of gravity of the outboard motor within the engine holder. The mount units are inserted into mount holders from the front side of the engine holder. The driveshaft is inserted between the mount holders and the mount holders are formed as close as possible to a protective wall for the driveshaft so that the mount holders can clear the protective wall.

U.S. Pat. No. 6,390,863, which issued to Imanaga on May 21, 2002, describes an outboard motor which incorporates a mount unit including upper and lower mount devices for mounting the outboard motor to the hull and a bracket through which the upper and lower mount devices are mounted to the hull. It also incorporates an elastic thrust stopper disposed between the bracket and a body of the outboard motor and a propeller driven in accordance with the engine operation. The distance between an axis of the upper mount device and an axis of the elastic thrust stopper both extend in a direction parallel to an axis of the propeller.

U.S. Pat. No. 6,419,534, which issued to Helsel et al. on Jul. 16, 2002, discloses a structural support system for an outboard motor. The support system uses four connectors attached to a support structure and to an engine system for isolating vibration from being transmitted to the marine vessel to which the outboard is attached. Each connector comprises an elastomeric portion for the purpose of isolating the vibration. Furthermore, the four connectors are disposed in a common plane which is generally perpendicular to a central axis of a driveshaft of the outboard motor. Although precise perpendicularity with a driveshaft axis is not required, it has been determined that if the plane extending through the connectors is within forty-five degrees perpendicularity with the driveshaft axis, improved vibration isolation can be achieved. A support structure, or support saddle, completely surrounds the engine system in the plane of the connectors. All of the support of the outboard motor is provided by the connectors within the plane, with no additional support provided at a lower position on the outboard motor driveshaft housing.

The patents described above are hereby expressly incorporated by reference in the description of the present invention.

SUMMARY OF THE INVENTION

A support mechanism for an outboard motor, made in accordance with a preferred embodiment of the present invention, comprises an attachment bar having a first portion and a second portion. The attachment bar has a central axis and the first portion is attachable to a steering structure. A tubular outer member is spaced apart from the second portion of the attachment bar and disposed in generally coaxial relation with the attachment bar. An elastomeric member is attached to the tubular outer member and to the attachment bar. The tubular outer member is attachable to an engine support structure of the outboard motor. The tubular outer member is configured to attach the second portion of the attachment bar to the engine support structure in response to a compressive force being exerted on the tubular outer member in a direction parallel to the central axis of the attachment bar and against a surface of the engine support structure.

In a preferred embodiment of the present invention, the first portion of the attachment bar comprises a rod which is attachable to the steering structure and the second portion of the attachment bar comprises an extension member attached to the rod. The extension member is attached to the elastomeric member. A threaded member is configured to be received in threaded association with a threaded opening in the engine support structure and to exert the compressive force on the tubular outer member in the direction parallel to the central axis of the attachment bar and against the surface of the engine support structure.

In a preferred embodiment of the present invention, the support mechanism further comprises a spacer which is disposed axially between the tubular outer member and the threaded member and a retaining device is associated with the attachment bar. The retaining device, which can be a washer, and the spacer are shaped to prevent the attachment bar from passing through the spacer in the event that the elastomeric member is damaged. The preferred embodiment of the present invention can further comprise a pin extending from the attachment bar in an axial direction. The pin is shaped to be received in a hole formed in the steering structure. It facilitates installation of the present invention in an outboard motor.

The tubular outer member and the elastomeric member are configured to respond to a radially inward force exerted on the tubular outer member with radial compression of the elastomeric member between the attachment bar and the exerted radial force in combination with radial tension of the elastomeric member on a side of the attachment bar which is radially opposite to the exerted radial force. The tubular outer member, the attachment bar and the elastomeric member are configured to respond to an axial force exerted on the tubular outer member, relative to the attachment bar, with a shear reaction within the elastomeric member.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
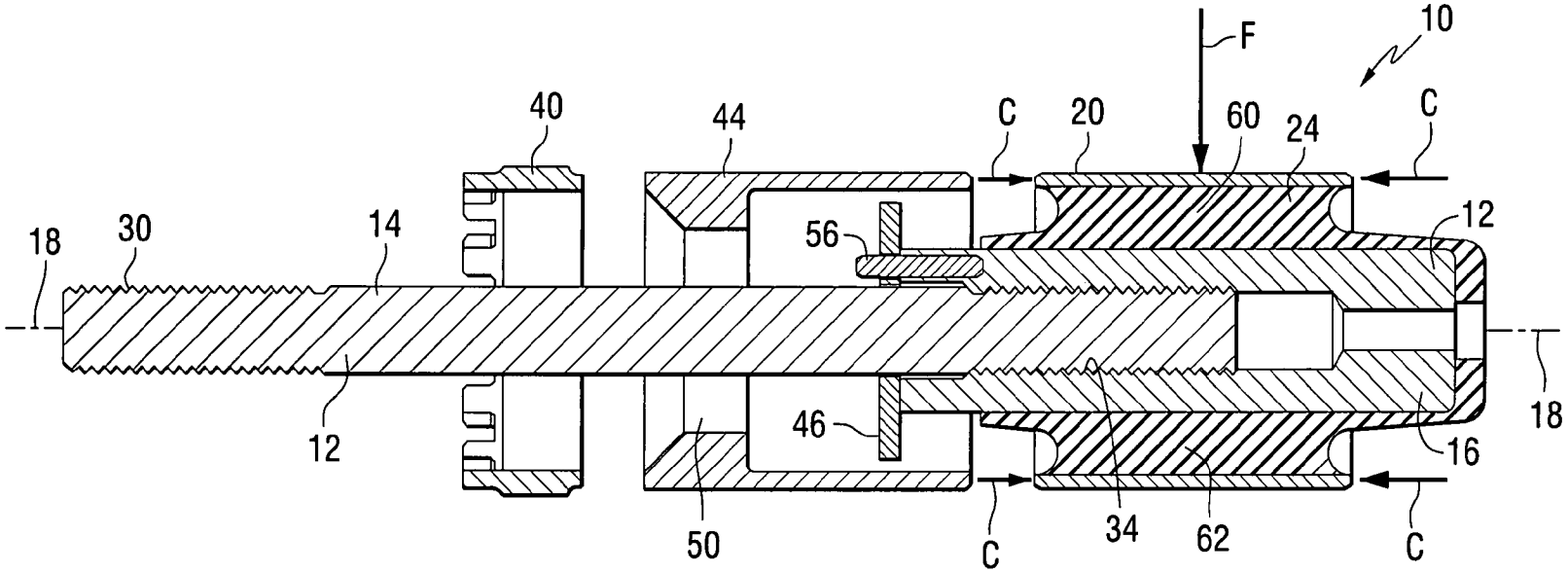
FIG. 1 is a section view of a preferred embodiment of the present invention.

Throughout the description of the preferred embodiment of the present invention, like components will be identified by like reference numerals.

FIG. 1 shows the support mechanism 10 of a preferred embodiment of the present invention. An attachment bar 12 has a first portion 14 and a second portion 16. The attachment bar 12 has a central axis 18. The first portion 14 is attachable to a steering structure which will be described in greater detail below in conjunction with FIGS. 2 and 3.

A tubular outer member 20 is spaced apart from the second portion 16 of the attachment bar 12 and disposed in generally coaxial relation with the central axis 18 of the attachment bar 12. An elastomeric member 24 is attached to the tubular outer member 20 and to the attachment bar 12. The tubular outer member 24 is attachable to an engine support structure which will be described in greater detail below in conjunction with FIGS. 2 and 3.

The tubular outer member 20 is configured to attach the second portion 16 of the attachment bar 12 to the engine support structure in response to a compressive force exerted on the tubular outer member 20 in a direction parallel to the central axis 18 of the attachment bar 12 and against a surface of the engine support structure. This compressive force is represented by the arrows C in FIG. 1.

With continued reference to FIG. 1, the first portion 14 of the attachment bar 12 comprises a rod which is attachable to the steering structure. The threads 30 facilitate this attachment. The second portion 16 of the attachment bar 12 comprises an extension member which is attached to the rod of the first portion 14. The extension member of the second portion 16 is also attached to the elastomeric member 24.

As illustrated in FIG. 1, the first portion 14 of the attachment bar 12 is threaded, with threads 34, into the extension member which is the second portioned 16 of the attachment bar 12.

A threaded member 40, which can be a spanner nut, is configured to be received in threaded association with a threaded opening in the engine support structure. This relationship will be described in greater detail below. The threaded member 40 exerts the compressive force, represented by the arrows C in FIG. 1, on the tubular outer member 20 in a direction which is generally parallel to the central axis 18 of the attachment bar 12 and against a surface of the engine support structure.

With continued reference to FIG. 1, a spacer 44 is disposed between the tubular outer member 20 and the threaded member 40. A retaining device 46, such as a washer, is associated with the attachment bar 12. The retaining device 46 and the spacer 44 are shaped to prevent the attachment bar 12 from passing axially through the spacer in the event that the elastomeric member 24 is damaged. In other words, if a force is exerted on the attachment bar 12 in a direction toward the left in FIG. 1 or if a force is exerted toward the right in FIG. 1 on the spacer 44, the retaining device 46 will not permit the attachment bar 12 to pass completely through the opening 50 provided within the structure of the spacer 44 even if the elastomeric member 24 is damaged. In other words, the washer, or retaining device 46, cannot move toward the left in FIG. 1 relative to the spacer 44 by a sufficient distance to allow separation between the attachment bar 12 and the engine support structure to which the threaded member 40, the spacer 44, and the tubular outer member 20 are attached. This retention of the engine support structure to the steering structure is therefore not dependent on the continued integrity of the elastomeric member 24.

With continued reference to FIG. 1, a pin 56 extends from the second portion 16 of the attachment bar 12 in an axial direction (i.e. generally parallel to central axis 18). The pin 56 is shaped to be received in a hole formed in the steering structure (not shown in FIG. 1) to prevent rotation of the attachment bar 12 during installation and attachment to the steering structure. The retaining device 46, which is a washer in a preferred embodiment of the present invention, is also provided with a hole, as shown in FIG. 1, that allows the pin 56 to extend therethrough so that the pin can be received in a hole formed in the steering structure.

The tubular outer member 20 and the elastomeric member 24 are configured to respond to a radially inward force F exerted on the tubular outer member 20 with radial compression of the elastomeric member 24 between the attachment bar 12 and the exerted radial force F. In other words, the region of the elastomeric member 24 identified by reference numeral 60 experiences radial compression when the radially inward force F is exerted on the tubular outer member 20. Simultaneously, the region of the elastomeric member 24 identified by reference numeral 62 experiences tension. This results from the fact that the tubular outer member 20 and the second portion 16 of the attachment bar 12 are bonded to the elastomeric member 24. When the radially inward force F is exerted on the tubular outer member 20, it radially compresses region 60 and radially expands region 62.

With continued reference to FIG. 1, the tubular outer member 20, the attachment bar 12 and the elastomeric member 24 are configured to respond to an axial force exerted on the tubular outer member 20, relative to the attachment bar 12, with a sheer reaction within the structure of the elastomeric member 24. In other words, if an axial force toward the left in FIG. 1 is exerted on the attachment bar 12 and an axial force toward the right in FIG. 1 is exerted on the tubular outer member 20, these opposing axial forces are resisted by the elastomeric member 24 which experiences shear within its structure. These opposing axial forces are not resisted by the elastomeric member 24 acting in either compression or tension. Significant improvements in consistency of operation result from this structure.

Figure 2:
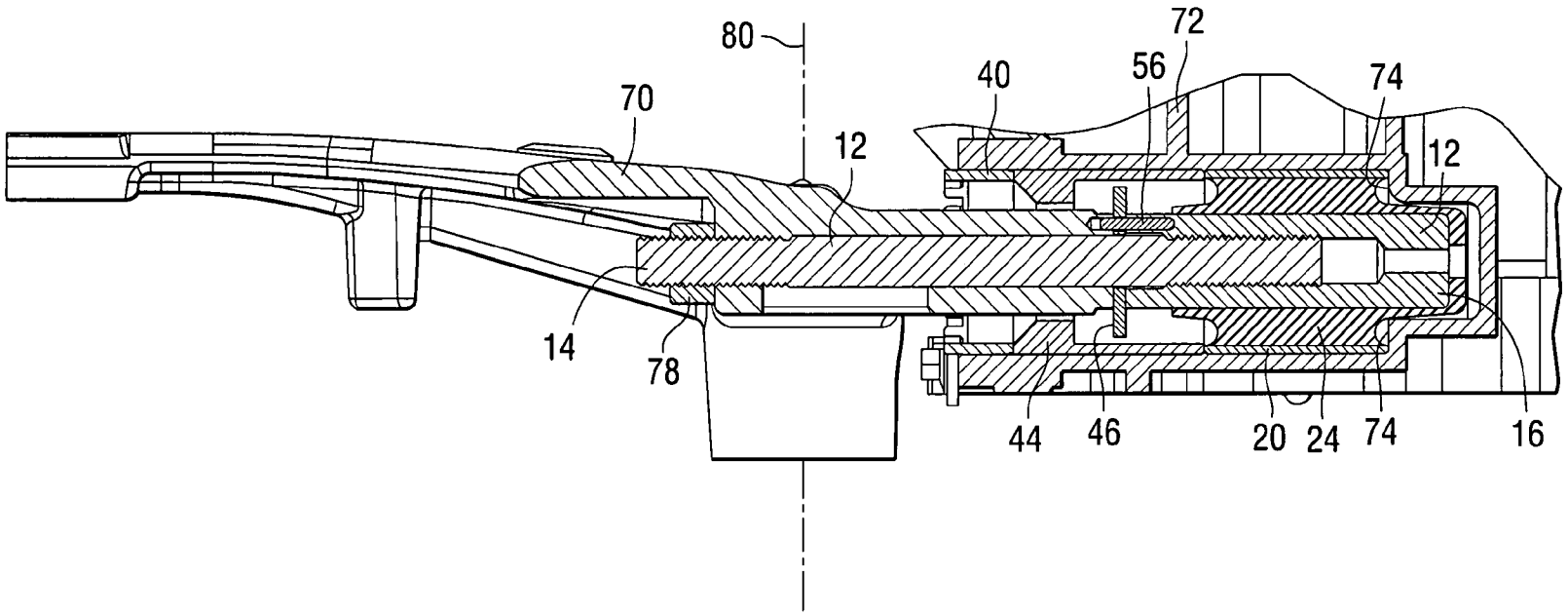
FIG. 2 shows the present invention associated with a steering structure and an engine support structure, in section view.

FIG. 2 is a section view of the support mechanism of the present invention associated with a steering structure 70 and an engine support structure 72. The spacer 44 is shown compressed between the threaded member 40 and the tubular outer member 20. This axially compresses the tubular outer member 20 between the spacer 44 and a surface 74 within the engine support structure 72. The threaded member 40, the spacer 44, the elastomeric member 24, and the surface 74 cooperate with each other to attach the second portion 16 of the attachment bar 12 to the engine support structure 72. The first portion 14 of the attachment bar 12 is attached to the steering structure 70 by passing the first portion 14 through an opening formed in the steering structure 70 and retaining the first portion 14 in position with a threaded component, such as the nut 78. It can be seen in FIG. 2 that the connection between the steering structure 70 and the engine support structure 72 is through the elastomeric member 24. As described above, the radially and axial forces exerted by the engine support structure 72 are all transmitted through the elastomeric member 24 which dampens their effect on the steering structure 70 and the marine vessel to which it is attached. For reference, a steering axis 80 is shown in FIG. 2.

Figure 3:
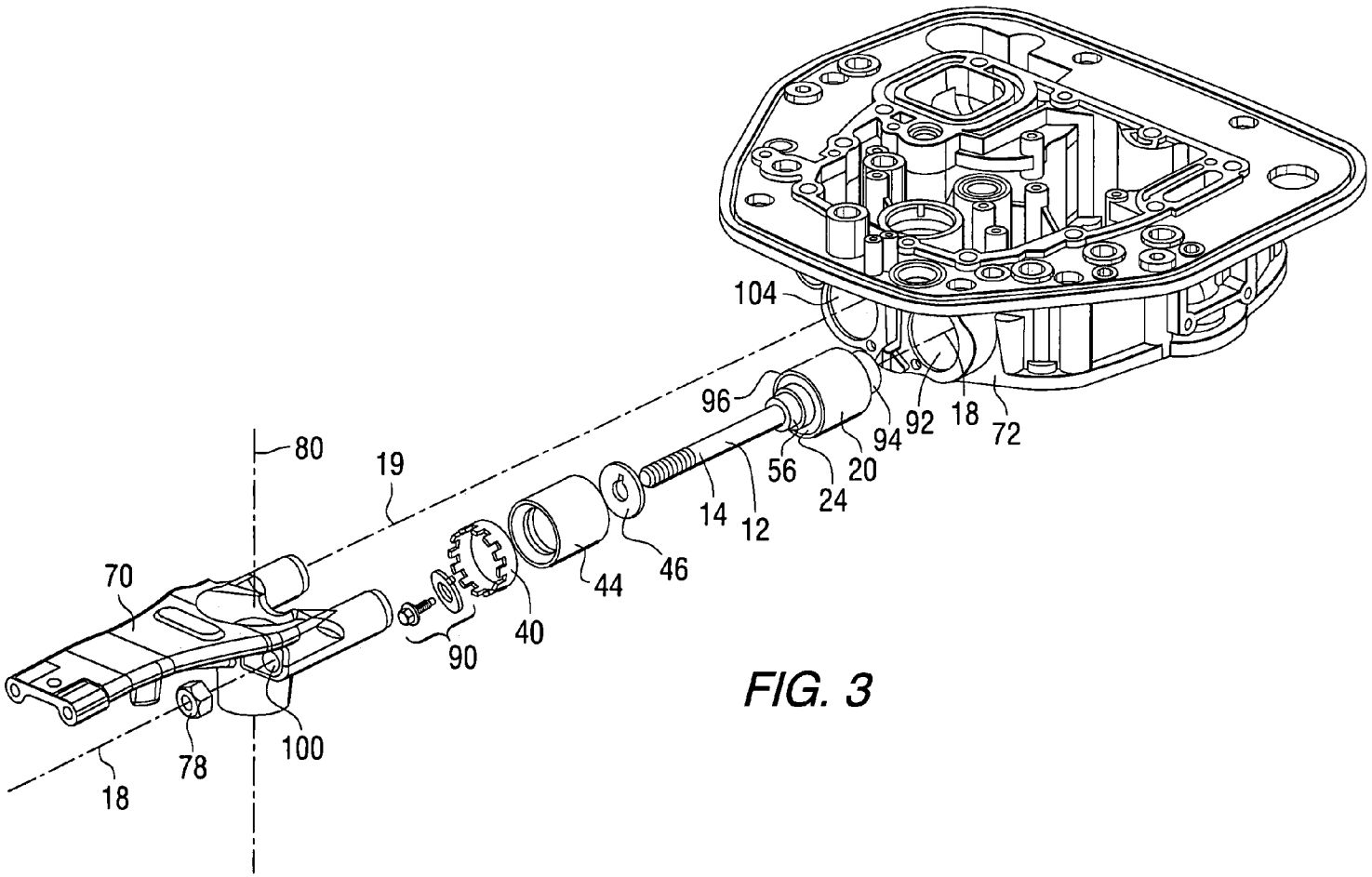
FIG. 3 is an exploded isometric view of the present invention associated with a steering structure and an engine support structure.

FIG. 3 is an exploded isometric view of the present invention associated with a steering structure 70 and an engine support structure 72 of an outboard motor. Although not shown specifically in FIG. 3, those skilled in the art of marine propulsion systems are familiar with the manner in which an engine is supported by the engine support structure 72, or adapter plate. In FIG. 3, a locking mechanism 90 is associated with the threaded member 40 to prevent it from rotating about the central axis 18 and becoming loose from the engine support structure 72.

With continued reference to FIG. 3, it should be understood that the present invention is intended to be used in pairs to attach the engine support structure 72 to the steering structure 70. Although only a single support mechanism is shown in FIG. 3, it should be understood that an identically configured support mechanism would normally be provided in parallel association and disposed about central axis 19.

The present invention is assembled by inserting the tubular outer member 20 into the opening identified by reference numeral 92 until the inward axial end 94 of the tubular outer member 20 moves into contact with the surface 74 of the engine support structure 72 as described above in conjunction with FIG. 2. The retaining device 46 and the spacer 44 are also disposed within the opening 92. The threaded member 40 is then threaded into mating threads of the opening 92 and tightened sufficient axial force is exerted through the spacer 44 against the outer axial surface 96 of the tubular outer member 20. This attaches the tubular outer member 20 to the engine support structure 72. The first portion 14 of the attachment bar 12 then extends outwardly from the engine support structure 72. It is inserted through a hole 100 within the steering structure 70 and the nut 78 is used to attach the attachment bar 12 to the steering structure 70. A similar support mechanism is attached to the engine support structure 72 in relation to opening 104 and aligned with central axis 19.

Although the present invention has been described in considerable detail and illustrated with specificity, it should be understood that alternative embodiments are also within its scope.

We claim:

1. A support mechanism for an outboard motor, comprising:

a connector having a first portion and a second portion, said connector having a central axis, said first portion being attachable to a first structure;

a tubular outer member spaced apart from said second portion of said connector and disposed in generally coaxial relation with said connector; and an elastomeric member disposed between said tubular outer member and said connector, said tubular outer member being attachable to a second structure, said tubular outer member being configured to attach said second portion of said connector to said second structure in response to a clamping force being exerted on said tubular outer member in a direction parallel to said central axis of said connector and against a surface of said second structure;

a spacer member disposed in coaxial relation with said connector and proximate said tubular outer member;

a washer disposed around said connector, said washer being shaped to prevent relative axial movement of said second portion of said connector in a direction away from said tubular outer member; and a pin extending in a direction parallel to said central axis, said washer having a first hole shaped to receive said pin therethrough.

2. The support mechanism of claim 1, further comprising:

a second hole formed in said first structure and shaped to receive said pin therein.

3. The support mechanism of claim 1, further comprising:

a threaded member configured to exert said clamping force on said tubular outer member in said direction parallel to said central axis of said connector and against said surface of said second structure.

4. The support mechanism of claim 1, wherein:

said tubular outer member and said elastomeric member are configured to respond to a radially inward force exerted on said tubular outer member with radial compression of said elastomeric member between said connector and said exerted radially inward force and radial tension of said elastomeric member on a side of said connector which is radially opposite to said exerted radially inward force.

5. The support mechanism of claim 1, wherein:

said connector comprises a rod member and an extension member.

6. The support mechanism of claim 5, wherein:

said extension member is disposed at said second portion of said connector and attached to said elastomeric member.

7. The support mechanism of claim 1, further comprising:

said first structure which is a steering structure of said outboard motor; and said second structure which is an engine support structure of said outboard motor.

8. The support mechanism of claim 7, wherein:

said first portion of said connector is shaped to be received within an opening within said steering structure; and said tubular outer member is shaped to be received within an opening within said engine support structure.

9. A support mechanism for an outboard motor, comprising:

an attachment bar having a first portion and a second portion, said attachment bar having a central axis, said first portion being attachable to a steering structure;

a tubular outer member spaced apart from said second portion of said attachment bar and disposed in generally coaxial relation with said attachment bar;

an elastomeric member attached to said tubular outer member and to said attachment bar, said tubular outer member being attachable to an engine support structure, said tubular outer member being configured to attach said second portion of said attachment bar to said engine support structure in response to a compressive force being exerted on said tubular outer member in a direction parallel to said central axis of said attachment bar and against a surface of said engine support structure;

a threaded member configured to be received in threaded association with a threaded opening in said engine support structure and to exert said compressive force on said tubular outer member in said direction parallel to said central axis of said attachment bar and against said surface of said engine support structure.

10. The support mechanism of claim 9, wherein:

said first portion of said attachment bar comprises a rod, said rod being attachable to said steering structure; and said second portion of said attachment bar comprises an extension member attached to said rod, said extension member being attached to said elastomeric member.

11. The support mechanism of claim 9, further comprising:

a spacer disposed between said tubular outer member and said threaded member.

12. The support mechanism of claim 11, further comprising:

a retaining device associated with said attachment bar, said retaining device and said spacer being shaped to prevent said attachment bar from passing through said spaced in the event that said elastomeric member is damaged.

13. The support mechanism of claim 9, further comprising:

a pin extending from said attachment bar in an axial direction, said pin being shaped to be received in a hole formed in said steering structure.

14. The support mechanism of claim 9, wherein:

said tubular outer member and said elastomeric member are configured to respond to a radially inward force exerted on said tubular outer member with radial compression of said elastomeric member between said attachment bar and said exerted radially inward force and radial tension of said elastomeric member on a side of said attachment bar which is radially opposite to said exerted radially inward force.

15. The support mechanism of claim 9, wherein:

said tubular outer member, said attachment bar and said elastomeric member are configured to respond to an axial force exerted on said tubular outer member, relative to said attachment bar, with a shear reaction within said elastomeric member.

16. A support mechanism for an outboard motor, comprising:

an attachment bar having a first portion and a second portion, said attachment bar having a central axis, said first portion being attachable to a steering structure;

a tubular outer member spaced apart from said second portion of said attachment bar and disposed in generally coaxial relation with said attachment bar;

an elastomeric member attached to said tubular outer member and to said attachment bar, said tubular outer member being attachable to an engine support structure, said tubular outer member being configured to attach said second portion of said attachment bar to said engine support structure in response to a compressive force being exerted on said tubular outer member in a direction parallel to said central axis of said attachment bar and against a surface of said engine support structure, said first portion of said attachment bar comprising a rod which is attachable to said steering structure, said second portion of said attachment bar comprising an extension member attached to said rod and to said elastomeric member; and a threaded member configured to be received in threaded association with a threaded opening in said engine support structure and to exert said compressive force on said tubular outer member in said direction parallel to said central axis of said attachment bar and against said surface of said engine support structure.

17. The support mechanism of claim 16, further comprising:

a spacer disposed between said tubular outer member and said threaded member;

a retaining device associated with said attachment bar, said retaining device and said spacer being shaped to prevent said attachment bar from passing through said spaced in the event that said elastomeric member is damaged;

a pin extending from said attachment bar in an axial direction, said pin being shaped to be received in a hole formed in said steering structure.

18. The support mechanism of claim 17, wherein:

said tubular outer member and said elastomeric member are configured to respond to a radially inward force exerted on said tubular outer member with radial compression of said elastomeric member between said attachment bar and said exerted radially inward force and radial tension of said elastomeric member on a side of said attachment bar which is radially opposite to said exerted radially inward force.

19. The support mechanism of claim 18, wherein:

said tubular outer member, said attachment bar and said elastomeric member are configured to respond to an axial force exerted on said tubular outer member, relative to said attachment bar, with a shear reaction within said elastomeric member.

* * * * *